US009982545B2

(12) United States Patent
Hirakawa et al.

(10) Patent No.: US 9,982,545 B2
(45) Date of Patent: May 29, 2018

(54) PRECIPITATION HARDENED MARTENSITIC STAINLESS STEEL, MANUFACTURING METHOD THEREFOR, AND TURBINE MOVING BLADE AND STEAM TURBINE USING THE SAME

(71) Applicant: MITSUBISHI HITACHI POWER SYSTEMS, LTD., Yokohama (JP)

(72) Inventors: Yuichi Hirakawa, Hyogo-ken (JP); Yoshikuni Kadoya, Hyogo-ken (JP); Hiroharu Ooyama, Hyogo-ken (JP); Tatsuya Furukawa, Hyogo-ken (JP); Naoto Tochitani, Tokyo (JP)

(73) Assignee: MITSUBISHI HITACHI POWER SYSTEMS, LTD., Yokohama (JP)

( * ) Notice: Subject to any disclaimer, the term of this patent is extended or adjusted under 35 U.S.C. 154(b) by 226 days.

(21) Appl. No.: 14/798,897

(22) Filed: Jul. 14, 2015

(65) Prior Publication Data

US 2015/0315921 A1 Nov. 5, 2015

Related U.S. Application Data

(62) Division of application No. 11/135,385, filed on May 24, 2005, now abandoned.

(30) Foreign Application Priority Data

Dec. 8, 2004 (JP) ..... 2004-355216

(51) Int. Cl.
*F01D 5/28* (2006.01)
*C21D 9/00* (2006.01)
(Continued)

(52) U.S. Cl.
CPC ..... *F01D 5/286* (2013.01); *C21D 6/004* (2013.01); *C21D 6/005* (2013.01); *C21D 6/008* (2013.01);
(Continued)

(58) Field of Classification Search
CPC ..... C21D 6/004; C21D 2211/008; C21D 9/0068; F01D 5/02; C22C 38/40
(Continued)

(56) References Cited

U.S. PATENT DOCUMENTS

| | | | |
|---|---|---|---|
| 3,278,298 | A | 10/1966 | Perry |
| 3,342,590 | A | 9/1967 | Bieber |
| 5,888,449 | A | 3/1999 | Kennedy et al. |

FOREIGN PATENT DOCUMENTS

| | | |
|---|---|---|
| GB | 1056561 | 1/1967 |
| JP | 61-96061 | 5/1986 |

(Continued)

OTHER PUBLICATIONS

European Search Report dated Aug. 12, 2005 in corresponding European Patent Application No. 05291176.5.
Japanese Office Action dated Dec. 1, 2006 in corresponding Japanese Patent Application No. 2004-355216 with partial English translation.
U.S. Office Action dated Dec. 12, 2007 in corresponding U.S. Appl. No. 11/135,385.

(Continued)

*Primary Examiner* — Jie Yang
(74) *Attorney, Agent, or Firm* — Wenderoth, Lind & Ponack, L.L.P.

(57) ABSTRACT

The precipitation hardened martensitic stainless steel is characterized by containing, in percent by weight, 12.25 to 14.25% Cr, 7.5 to 8.5% Ni, 1.0 to 2.5% Mo, 0.05% or less C, 0.2% or less Si, 0.4% or less Mn, 0.03% or less P, 0.005% or less S, 0.008% or less N, 0.90 to 2.25% Al, the balance substantially being Fe, and the total content of Cr and Mo being 14.25 to 16.75%. A turbine moving blade and a steam turbine are manufactured by using this martensitic stainless steel.

13 Claims, 11 Drawing Sheets

(51) Int. Cl.

| | |
|---|---|
| ***C21D 6/02*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***F01D 5/02*** | (2006.01) |
| ***F01D 5/12*** | (2006.01) |

(52) U.S. Cl.
CPC ..... *C21D 6/02* (2013.01); *C21D 9/0068* (2013.01); *C22C 38/001* (2013.01); *C22C 38/02* (2013.01); *C22C 38/04* (2013.01); *C22C 38/06* (2013.01); *C22C 38/44* (2013.01); *C22C 38/48* (2013.01); *F01D 5/02* (2013.01); *F01D 5/12* (2013.01); *C21D 2211/008* (2013.01); *F05C 2201/0466* (2013.01); *F05D 2220/30* (2013.01); *F05D 2220/31* (2013.01); *F05D 2230/00* (2013.01); *F05D 2230/411* (2013.01); *F05D 2300/11* (2013.01); *F05D 2300/121* (2013.01); *F05D 2300/125* (2013.01); *F05D 2300/131* (2013.01); *F05D 2300/132* (2013.01); *F05D 2300/171* (2013.01)

(58) Field of Classification Search
USPC ..... 420/34
See application file for complete search history.

(56) References Cited

FOREIGN PATENT DOCUMENTS

| | | |
|---|---|---|
| JP | 5-125490 | 5/1993 |
| JP | 7-258729 | 10/1995 |
| JP | 11-50205 | 2/1999 |
| JP | 3251648 | 11/2001 |

OTHER PUBLICATIONS

U.S. Office Action dated Jul. 7, 2008 in corresponding U.S. Appl. No. 11/135,385.
U.S. Office Action dated Feb. 18, 2009 in corresponding U.S. Appl. No. 11/135,385.
U.S. Office Action dated Sep. 21, 2009 in corresponding U.S. Appl. No. 11/135,385.
U.S. Office Action dated Jun. 17, 2013 in corresponding U.S. Appl. No. 11/135,385.
U.S. Office Action dated Oct. 24, 2013 in corresponding U.S. Appl. No. 11/135,385.
U.S. Office Action dated Aug. 18, 2014 in corresponding U.S. Appl. No. 11/135,385.
U.S. Office Action dated Jan. 26, 2015 in corresponding U.S. Appl. No. 11/135,385.
U.S. Advisory Action dated Jun. 2, 2015 in corresponding U.S. Appl. No. 11/135,385.
U.S. Patent Board Decision dated Jun. 28, 2012 in corresponding U.S. Appl. No. 11/135,385.
U.S. Examiner's Answer dated Jul. 8, 2010 in corresponding U.S. Appl. No. 11/135,385.
U.S. Advisory Action dated Nov. 7, 2008 in corresponding U.S. Appl. No. 11/135,385.

PRECIPITATION HARDENED MARTENSITIC STAINLESS STEEL, MANUFACTURING METHOD THEREFOR, AND TURBINE MOVING BLADE AND STEAM TURBINE USING THE SAME

TECHNICAL FIELD

The present invention relates to a precipitation hardened martensitic stainless steel having high strength, high toughness, and high resistance to delayed cracking, a manufacturing method therefor, and a turbine moving blade and a steam turbine using the martensitic stainless steel.

BACKGROUND ART

In order to improve the thermal efficiency of a steam turbine, it is advantageous to increase the blade length of a low-pressure final-stage moving blade. In order to increase the length of a turbine moving blade, a blade material having high specific strength is needed. However, in a steam turbine of 3600 rpm, at present, a 40-inch class is a limit for a steel-made blade, and hence a titanium alloy is used for a 45-inch class.

As a high-strength steel material for a turbine blade, Japanese Patent Provisional Publication No. 2001-98349 describes a martensitic stainless steel having a composition, in percent by weight, of 0.13 to 0.40% C, 0.5% or less Si, 1.5% or less Mn, 2 to 3.5% Ni, 8 to 13% Cr, 1.5 to 4% Mo, a total of 0.02 to 0.3% Nb and Ta, 0.05 to 0.35% V, and 0.04 to 0.15% N, the balance being Fe.

Also, as a precipitation hardened stainless steel having high strength, high toughness, and high corrosion resistance, a large number of techniques have been disclosed in the patent literature. Among these, as a stainless steel of martensite single phase, Table 1 in Japanese Patent No. 3251648 sets forth a precipitation hardened martensitic stainless steel having a composition, in percent by weight, of 0.8% or less C, 0.7 to 2.5% Si, 3.0% or less Mn, 6.0 to 7.2% Ni, 10.0 to 17.0% Cr, 0.5 to 2.0% Cu, 0.5 to 3.0% Mo, 0.15 to 0.45% Ti, 0.015% or less N, and 0.003% or less S, the balance being Fe.

A high-strength steel material for a turbine moving blade must have a high strength such that the tensile strength of a material for a blade having a 45-inch class blade length for a steam turbine of 3600 rpm is 1350 MPa or higher and the tensile strength of a material for a blade having a 50-inch class blade length is 1500 MPa or higher, a high toughness such that Charpy absorbed energy at room temperature is 20 J or higher, and a high resistance to delayed cracking (SCC). However, for a tempered martensitic stainless steel, in which the strength is controlled by quench-and-temper, as described in Japanese Patent Provisional Publication No. 2001-98349, if the tensile strength is increased to 1350 MPa or higher, a delayed crack may be generated as described later. On the other hand, for a precipitation hardened martensitic stainless steel, although high strength, high toughness, and high corrosion resistance are achieved, the precipitate of Cu, Nb or Ti alone of the background art does not provide a sufficient strength as compared with a required value of 1500 MPa or higher. For the technique described in Japanese Patent No. 3251648, although high strength and high toughness are achieved by decreasing the crystal grain size, it is difficult to obtain a fine grain structure in a thick portion such as a turbine blade root portion, which presents a problem of insufficient strength and toughness.

DISCLOSURE OF THE INVENTION

The present invention has been made to solve the above problems, and accordingly an object thereof is to provide a precipitation hardened martensitic stainless steel having a high strength such that tensile strength is 1350 MPa or higher, a high toughness such that Charpy absorbed energy at room temperature is 20 J or higher, and a high resistance to delayed cracking, a manufacturing method therefor, and a turbine moving blade and a steam turbine using the precipitation hardened martensitic stainless steel.

To achieve the above object, the precipitation hardened martensitic stainless steel in accordance with the present invention is characterized by containing, in percent by weight, 12.25 to 14.25% Cr, 7.5 to 8.5% Ni, 1.0 to 2.5% Mo, 0.05% or less C, 0.2% or less Si, 0.4% or less Mn, 0.03% or less P, 0.005% or less S, 0.008% or less N, 0.90 to 2.25% Al, the balance substantially being Fe, and the total content of Cr and Mo being 14.25 to 16.75%. Also, in the precipitation hardened martensitic stainless steel in accordance with the present invention, it is preferable that $$\text{Cr equivalent}=[Cr]+2[Si]+1.5[Mo]+5.5[Al]+1.75[Nb]+1.5[Ti]$$

$$\text{Ni equivalent}=[Ni]+30[C]+0.5[Mn]+25[N]+0.3[Cu],$$

and the Cr equivalent be less than 28.0, and the Ni equivalent be less than 10.5. In the above formulas, the unit in the parentheses is percent by weight. By controlling the Cr equivalent and the Ni equivalent in this manner, the precipitation of a δ ferrite phase and a residual austenite phase can be reliably prevented, so that high toughness and high hot forging property can be secured.

Also, the total content of Cr and Mo is preferably made 15.5 to 16.75%. By limiting the total content of Cr and Mo as described above, a precipitation hardened martensitic stainless steel having a high strength such that tensile strength is not lower than 1500 MPa, a high toughness such that Charpy absorbed energy at room temperature is not lower than 20 J, and a high resistance to delayed cracking can be provided.

Further, the Al content is preferably made higher than 1.35% and not lower than 2.25%. By limiting the Al content to such a high range, a precipitation hardened martensitic stainless steel having a high strength such that tensile strength is not lower than 1500 MPa, a high toughness such that Charpy absorbed energy at room temperature is not lower than 20 J, and a high delayed crack resistance can be provided. Also, by limiting the Al content to such a high range, a tensile strength not lower than 1500 MPa can be achieved even at a high aging temperature not lower than 550° C., and because the aging temperature is high, high delayed crack resistance can be provided even when the total content of Cr and Mo is still in a low range of not higher than 15.5%.

As another aspect, the present invention provides a manufacturing method for a precipitation hardened martensitic stainless steel, characterized in that a steel billet, which has a chemical composition, in percent by weight, of 12.25 to 14.25% Cr, 7.5 to 8.5% Ni, 1.0 to 2.5% Mo, 0.05% or less C, 0.2% or less Si, 0.4% or less Mn, 0.03% or less P, 0.005% or less S, 0.008% or less N, 0.90 to 2.25% Al, the balance substantially being Fe, and the total content of Cr and Mo being 14.25 to 16.75%, is subjected to aging treatment at 510 to 550° C. after being subjected to solution heat treatment at 910 to 940° C. In this case, the total content of Cr and Mo is preferably 15.5 to 16.75.

Also, as still another aspect, the present invention provides a manufacturing method for a precipitation hardened martensitic stainless steel, characterized in that a steel billet, which has a chemical composition, in percent by weight, of 12.25 to 14.25% Cr, 7.5 to 8.5% Ni, 1.0 to 2.5% Mo, 0.05% or less C, 0.2% or less Si, 0.4% or less Mn, 0.03% or less P, 0.005% or less S, 0.008% or less N, 1.35 to 2.25% Al, the balance substantially being Fe, and the total content of Cr and Mo being 14.25 to 16.75%, is subjected to aging treatment at 550 to 600° C. after being subjected to solution heat treatment at 910 to 940° C. In both of the above-described aspects of the manufacturing method for a precipitation hardened martensitic stainless steel, it is preferable that the Cr equivalent be less than 28.0, and the Ni equivalent be less than 10.5.

Also, as still another aspect, the present invention provides a turbine moving blade using the above-described precipitation hardened martensitic stainless steel. Thereby, a long blade having a 45-inch class blade length (for a steam turbine of 3600 rpm), for which a titanium alloy has conventionally been used, can also be made of a steel, so that the cost can be reduced.

Further, as still another aspect, the present invention provides a steam turbine provided with the turbine moving blade using the above-described precipitation hardened martensitic stainless steel and a rotor in which a 9 to 12 Cr steel is used for at least a long blade implanting portion. By using the 9 to 12 Cr steel for the long blade implanting portion as described above, the SCC strength of a blade groove can be increased, so that a low-cost and highly reliable steam turbine can be provided.

According to the present invention, there can be provided a precipitation hardened martensitic stainless steel having a high strength such that tensile strength is not lower than 1350 MPa, a high toughness such that Charpy absorbed energy at room temperature is not lower than 20 J, and a high delayed crack resistance, a manufacturing method therefor, and a turbine moving blade and a steam turbine using the martensitic stainless steel.

BEST MODE FOR CARRYING OUT THE INVENTION

Figure 1:
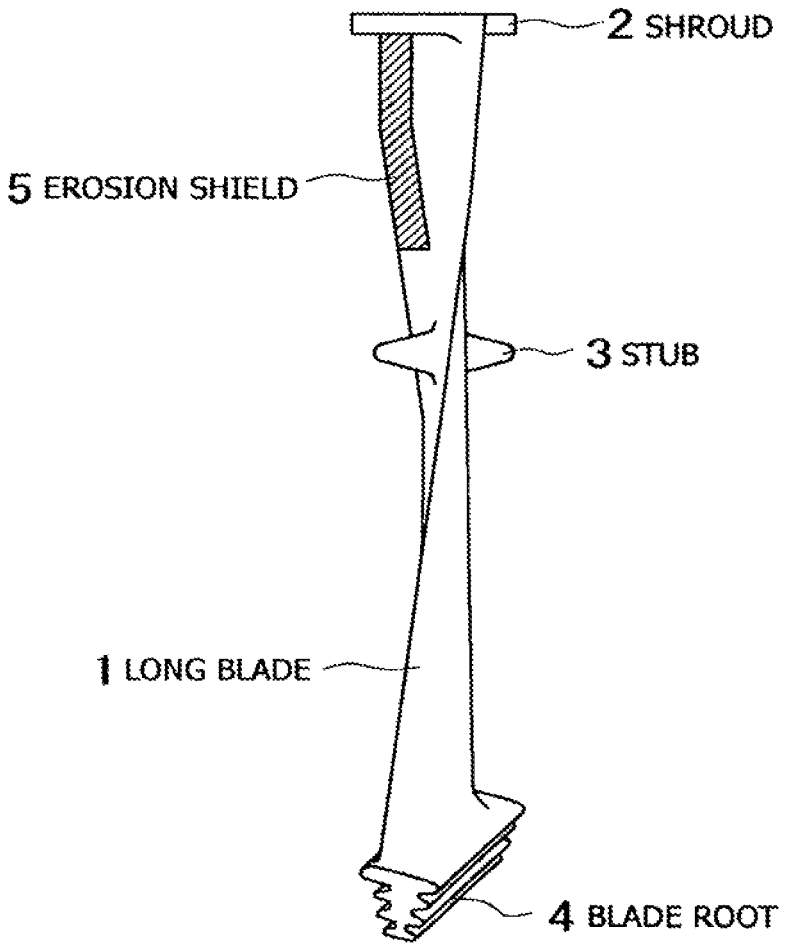
FIG. 1 is a schematic view showing one example of a long blade having a 45-inch class blade length.

Components contained in a precipitation hardened martensitic stainless steel in accordance with the present invention and the contents thereof will now be explained. In the explanation below, the percentage expressing the content is a percentage by weight unless otherwise described.

For chromium (Cr), at least 12.25% of Cr must be contained to provide high corrosion resistance and high delayed crack resistance. On the other hand, if the Cr content exceeds 14.5%, a δ ferrite phase precipitates in large amounts, which results in degradation of mechanical properties such as tensile strength and toughness. Therefore, to be on the safe side, the upper limit of Cr content should be 14.25%. For this reason, the Cr content was set in the range of 12.25 to 14.25%.

Nickel (Ni) is an indispensable element that restrains the precipitation of δ ferrite phase, and contributes to precipitation hardening by forming an intermetallic compound with aluminum (Al). In the present invention, at least 7.5% of Ni must be contained to provide high strength and high toughness. On the other hand, if the Ni content exceeds 8.5%, a residual austenite phase is yielded, so that the necessary strength cannot be obtained. Therefore, the Ni content was set in the range of 7.5 to 8.5%.

Molybdenum (Mo) is an alloy element that is effective in improving corrosion resistance and delayed crack (SCC) resistance together with chromium (Cr). To achieve this effect, at least 1.0% of Mo must be contained. On the other hand, if the content of Mo exceeds 2.5%, the precipitation of δ ferrite phase is accelerated, which becomes one reason for a decrease in toughness. Therefore, the Mo content was set in the range of 1.0 to 2.5%.

Also, it has been found that the total content of Cr and Mo correlates well with the tensile strength at a limit at which a crack is generated by a delayed cracking test (delayed crack generation limit strength). Therefore, in order to provide high resistance to delayed cracking (SCC) with a tensile strength of 1350 MPa or higher, the total content of Cr and Mo was set in the range of 14.25 to 16.25%. Further, in order to provide high SCC resistance even with a tensile strength of 1500 MPa or higher, the total content of Cr and Mo is preferably limited to the range of 15.5 to 16.25%. As described later, in the case where the Al content is high, and the tensile strength is 1500 MPa or higher even at an aging temperature of 550° C. or higher, a high delayed crack resistance can be provided even when the total content of Cr and Mo is still in a low range of less than 15.5%.

From the viewpoint of high strength, high toughness, and other high mechanical properties, the precipitation of δ ferrite phase is preferably within 1% in volume fraction. The precipitation of δ ferrite phase can be avoided by making the Cr equivalent 28.0 or less. Also, if the residual austenite phase precipitates even if the precipitation of δ ferrite phase is avoided, a desirable strength cannot be obtained. The precipitation of residual austenite phase can be avoided by making the Ni equivalent 10.5 or less. That is to say, by making the Cr equivalent 28.0 or less and making the Ni equivalent 10.5 or less, both of the δ ferrite phase and the residual austenite phase can be avoided. The Cr equivalent and the Ni equivalent are expressed by the following formulas.

$$\text{Cr equivalent}=[Cr]+2[Si]+1.5[Mo]+5.5[Al]+1.75[Nb]+1.5[Ti]$$

$$\text{Ni equivalent}=[Ni]+30[C]+0.5[Mn]+25[N]+0.3[Cu]$$

Carbon (C) is an element that is effective in restraining the δ ferrite phase. However, if the C content increases, the residual austenite phase is yielded, so that sufficient strength cannot be obtained because a martensite single phase structure is not formed by cooling after solution heat treatment. Also, the precipitation of carbide exerts an adverse influence on the corrosion resistance. Therefore, the upper limit of C content was set at 0.05%. More favorably, the upper limit thereof is 0.01 to 0.05%.

Aluminum (Al), which forms an intermetallic compound with nickel (Ni) and thereby contributes to precipitation hardening, is an indispensable and important element. In order to achieve effective precipitation hardening power, at least 0.90% of Al must be contained. On the other hand, if the Al content exceeds 2.25%, the toughness and hot forging property are remarkably reduced by excessive precipitation or the yield of δ ferrite phase. Therefore, the Al content was set in the range of 0.90 to 2.25%.

Also, it has been found that the tensile strength increases as the Al content increases. In particular, by limiting the Al content to a high range such that it is higher than 1.35% and not higher than 2.25%, even under a high aging temperature condition of 550° C., which is a sufficiently excessive aging condition, high strength and high toughness such that tensile strength is 1350 MPa or higher and Charpy absorbed energy at room temperature is 20 J or higher can be achieved. Also, by limiting the Al content to the aforementioned high range and by limiting the aging temperature to a high range of 550° C. or higher, generation of delayed cracks can be restrained even in a state in which the total content of Cr and Mo is still limited to a low range of 15.5% or less. Further, by limiting the total content of Cr and Mo to the above-described low range, the precipitation of δ ferrite phase can be restrained, and hence the phase stability of a large steel ingot can be improved.

Manganese (Mn) is an element that is effective in restraining the yield of δ ferrite phase. However, if the Mn content increases, the residual austenite phase is yielded, so that a sufficient strength cannot be obtained. Therefore, the upper limit of Mn content was set at 0.4%, which is a limit content such that the steel can be manufactured by an atmospheric melting method and the targets of strength and toughness can be attained. The addition of Mn is not necessarily needed when a vacuum induction melting method, a vacuum arc remelting method, an electroslag remelting method, or the like method is used. Therefore, the Mn content can be set at 0.1% or less, preferably 0.05% or less.

Silicon (Si) is an effective element as a deoxidizer for molten steel. However, if the Si content increases, the yield of δ ferrite phase is accelerated, and thus the strength and toughness are decreased. Therefore, the upper limit of Si content was set at 0.2%, which is a limit content such that the steel can be manufactured by an atmospheric melting method and the targets of strength and toughness can be attained. The addition of Si is not necessarily needed when a vacuum induction melting method, a vacuum arc remelting method, an electroslag remelting method, or the like method is used. Therefore, the Si content can be set at 0.1% or less, preferably 0.05% or less.

Phosphorous (P) does not contribute to the increase in strength, and conversely exerts an adverse influence on toughness. Therefore, from the viewpoint of ensuring toughness, the P content is preferably reduced as far as possible. The upper limit of P content was set at 0.03%, which is a limit content such that the steel can be manufactured by an atmospheric melting method and the targets of strength and toughness can be attained. A more favorable range is 0.005% or less. In this case, it is preferable that the Si content be 0.1% or less and the Mn content be 0.1% or less.

Sulfur (S) exists in steel as a non-metallic inclusion, and exerts an adverse influence on fatigue strength, toughness, corrosion resistance, and the like. Therefore, the S content is preferably reduced as far as possible. The upper limit of S content was set at 0.005%.

Nitrogen (N) is an element that is effective in restraining the δ ferrite phase. However, if the N content increases, the yield of residual austenite phase results in a shortage of strength. Further, like phosphorus (P), an increase in N content exerts an adverse influence on the toughness. Therefore, the upper limit of the N content was set at 0.008%.

As other elements, niobium (Nb) and tantalum (Ta) can be added. Nb and Ta form carbides and thus achieve an effect of improving the strength, and on the other hand, degrade the toughness and hot forging property. Therefore, when these elements are added, the upper limit of the total content of Nb and Ta should be set at 0.01%. Also, although the balance of composition of the steel in accordance with the present invention is basically Fe, the steel is also contaminated inevitably by impurities.

Next, heat treatment of the precipitation hardened martensitic stainless steel in accordance with the present invention will be explained. A precipitation hardened martensitic stainless steel having the chemical composition specified above is first melted and forged into a predetermined shape. Subsequently, the forged steel is heated preferably to a temperature of 910 to 940° C., and then is water cooled or forcedly air cooled and subjected to solution heat treatment. By making the solution heat treatment temperature 910° C. or higher, the precipitate is formed into a solid solution, while precipitate that is not formed into a solid solution is lessened to thereby secure the toughness. Also, by making the temperature of solution heat treatment 940° C. or lower, a microstructure is obtained by the restraint of coarsening of crystal grains, and thereby a high toughness can be obtained. The heating time is not subject to any special restriction, but it is preferably 0.5 to 3 hours.

After the solution heat treatment, in the case where the Al content is not higher than 1.35%, the steel is heated preferably to a temperature of 510 to 550° C., and then is air cooled and subjected to aging treatment. By making the heating temperature for aging treatment 510° C. or higher, the Charpy absorbed energy at room temperature of the obtained steel can be made 20 J or higher, so that a high toughness can be obtained. Also, by making the temperature for aging treatment 550° C. or lower, the tensile strength at room temperature of the obtained steel can be made 1350 MPa or higher, so that a high strength can be obtained. In particular, by making the temperature for aging treatment 530° C. or lower, a higher strength can be obtained. The heating time for aging treatment is not subject to any special restriction, but it is preferably 3 to 5 hours.

Also, in the case where the Al content exceeds 1.35%, after the solution heat treatment, the steel is heated preferably to a temperature of 550 to 600° C., and then is air cooled and subjected to aging treatment. By making the heating temperature for aging treatment 550 to 600° C., the tensile strength at room temperature of the obtained steel can be made 1350 MPa or higher, and the Charpy absorbed energy at room temperature of the obtained steel can be made 20 J or higher, so that high strength and high toughness can be achieved. In particular, by limiting the temperature for aging treatment to 550 to 580° C., the tensile strength can be made 1350 MPa or higher, so that a higher strength can be obtained. The heating time for aging treatment is not subject to any special restriction, but it is preferably 3 to 5 hours.

Next, a turbine moving blade using the precipitation hardened martensitic stainless steel in accordance with the present invention will be explained. FIG. 1 shows one example of a long blade having a 45-inch class blade length for a steam turbine of 3600 rpm. As shown in FIG. 1, a long blade 1 has a serration type blade root 4. This blade root 4 is implanted in a rotor (not shown) in a side entry manner. A plurality of long blades 1 are provided so as to be implanted in a radial form at the outer periphery of the rotor, and adjoining long blades 1 are combined via a shroud 2 and a stub 3, by which an annular turbine blade lattice is formed.

An erosion shield 5 prevents erosion caused by water-drops. The erosion shield 5 is usually formed by brazing a stellite plate of a Co-based alloy. Also, the erosion shield 5 can be formed by using a hardened layer formed by surface hardening using a laser or high-frequency waves. Since the precipitation hardened martensitic stainless steel in accordance with the present invention has a hardness of about 450 Hv, the erosion shield 5 can be omitted in a mild environment. Although FIG. 1 shows an integral shroud moving blade in which the shroud 2 is molded integrally with the blade, the construction is not limited to this one. The present invention can be applied to a conventional blade.

By applying the precipitation hardened martensitic stainless steel in accordance with the present invention to the turbine moving blade in this manner, the conventional 45-inch class titanium blade can be replaced with a steel blade, by which the cost can be reduced significantly. The turbine moving blade in accordance with the present invention is not limited to a long blade having a 45-inch class blade length (for the steam turbine of 3600 rpm). As described above, by changing the chemical composition and heat treatment conditions, for example, by making the total content of Cr and Mo 15.5 to 16.75% and making the aging condition 510 to 530° C. in the case where the Al content is not higher than 1.35%, and by making the aging condition 550 to 580° C. in the case where the Al content exceeds 1.35%, a tensile strength of 1500 MPa or higher can be obtained, so that a long blade having a 50-inch class blade length (for the steam turbine of 3600 rpm) can also be manufactured. Also, the present invention can be applied to various types of long blades; for example, not only 54-inch class or 60-inch class long blade for the steam turbine of 3000 rpm, but also a longer blade for the steam turbine of 1500/1800 rpm.

Next, a steam turbine provided with the turbine moving blade in accordance with the present invention will be explained. As explained above, by using the precipitation hardened martensitic stainless steel in accordance with the present invention for the turbine moving blade, 45-inch class and 50-inch class long blades for the steam turbine of 3600 rpm can also be manufactured. However, since the increase in blade weight as compared with the titanium alloy blade also increases the centrifugal stress of a rotor blade groove, the SCC strength of blade groove is insufficient for the conventional low alloy steel rotor material. Therefore, a high-strength 9 to 12 Cr steel having an SCC strength higher than that of the low alloy steel is used as a rotor material, and a long blade using the martensitic stainless steel of the present invention is combined with the rotor, by which a steam turbine provided with a steel-made long blade of 45-inch or 50-inch class can be provided.

As the high-strength 9 to 12 Cr steel, the 9 to 12 Cr steel described, for example, in Japanese Patent Provisional Publication No. 2001-98349 or Japanese Patent No. 3251648 can be used. In particular, a high-strength heat resisting steel, in which 0.05 to 0.2% C, 2.5% or less Ni, 8 to 11% Cr, 0.3 to 2% Mo, 0.1 to 0.3% v, 0.01 to 0.08% N, and 0.02 to 0.15% Nb are contained, the balance being Fe and unavoidable impurities, and the unavoidable impurities contain 0.1% or less Si, 0.3% or less Mn, 0.015% or less P, and 0.008% or less S; or a high-strength and high-toughness heat resisting steel formed by a heat resisting steel in which for the heat resisting steel containing 0.08 to 0.25% C, 0.10% or less Si, 0.01% or less Mn, 0.05 to 1.0% Ni, 10.0 to 12.5% Cr, 0.6 to 1.9% Mo, 1.0 to 1.95% W, 0.10 to 0.35% V, 0.02 to 0.10% Nb, 0.01 to 0.08% N, 0.001 to 0.01% B, and 2.0 to 8.0% Co, the balance substantially being Fe, and the structure consisting of a tempered martensite substrate, the Cr equivalent determined by the formula of (Cr equivalent=Cr+6Si+4Mo+1.5W+11V+5Nb−40C−2Mn−4Ni−2Co−30N) is 7.5% or less, the B equivalent expressed as (B+0.5N) is 0.030% or less, the Nb equivalent expressed as (Nb+0.4C) is 0.12% or less, and the Mo equivalent expressed as (Mo+0.5W) is 1.40 to 2.45%, of the impurity elements, S is kept below 0.01%, and P is kept below 0.03%, $M_{23}C_6$ type carbide and intermetallic compounds are precipitated mainly at the crystal grain boundary and martensite lath boundary and MX type carbonitride is precipitated within the martensite lath, the total content of the precipitates being 1.8 to 4.5% is preferable.

Figure 2:
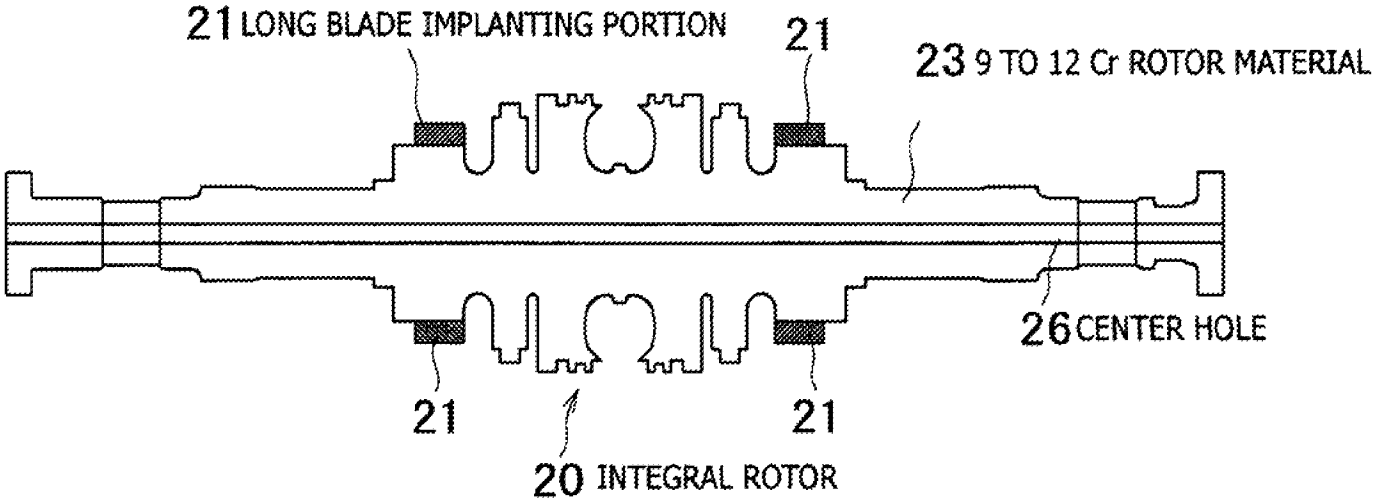
FIG. 2 is a sectional view showing one example of an integral low-pressure turbine rotor.

FIG. 2 shows one example of the steam turbine in accordance with the present invention. FIG. 2 is a sectional view of an integral low-pressure turbine rotor formed from a single rotor material. As shown in FIG. 2, the entire of an integral rotor 20 including long blade implanting portions 21 is formed from a 9 to 12 Cr rotor material, so that the SCC strength of blade groove can be increased to a strength capable of withstanding a 45-inch or 50-inch class long blade using the steel of the present invention. However, since the 9 to 12 Cr rotor material is higher in cost than a low alloy steel rotor material, there is a possibility that a cost merit brought about by the use of a steel-made long blade in place of a titanium-made long blade may be reduced. Therefore, by forming only the blade groove at the turbine final stage at which the 45-inch or 50-inch class blade for the turbine of 3600 rpm or the 54-inch or 60-inch class blade for the turbine of 3000 rpm is implanted from a 9 to 12 Cr steel, and by forming other portions from a conventional low alloy steel, the cost can be reduced. Examples thereof are shown in FIGS. 3 and 4.

Figure 3:
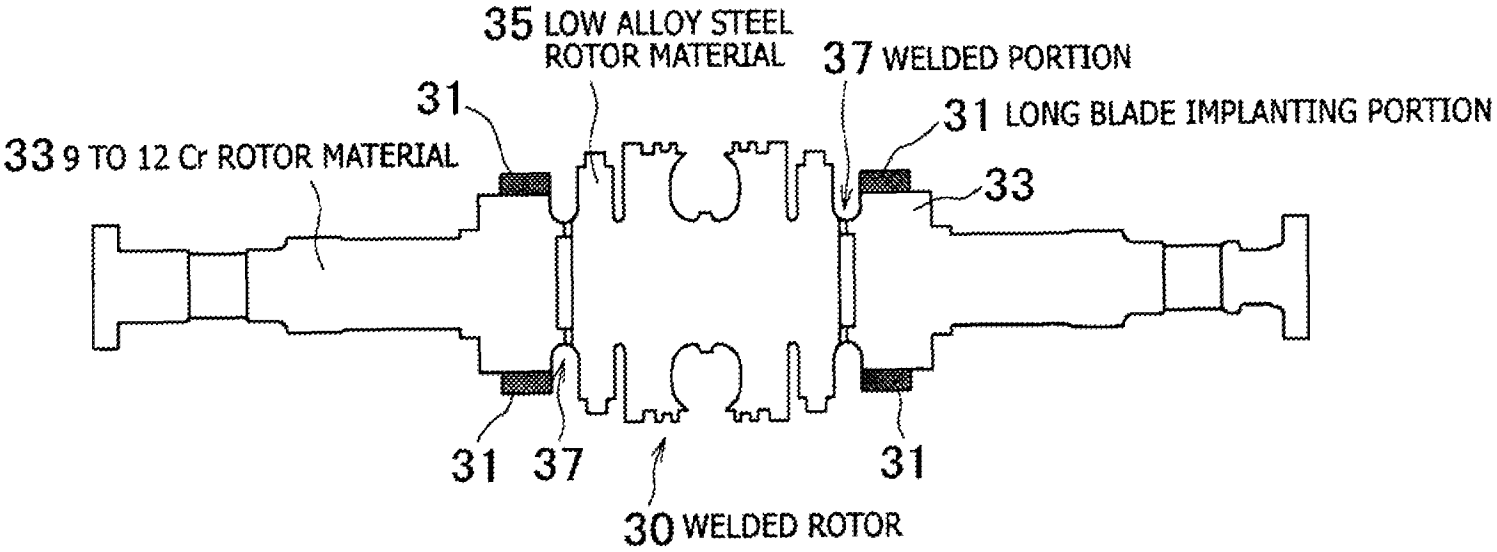
FIG. 3 is a sectional view showing one example of a welded low-pressure turbine rotor.

FIG. 3 is a sectional view of a welded low-pressure turbine rotor in which portions including a long blade implanting portion and other portions are welded to each other. As shown in FIG. 3, a welded rotor 30 includes rotor both-end portions including a long blade implanting portion 31 formed from a 9 to 12 Cr steel rotor material 33 and a rotor central portion formed from a low alloy steel rotor material 75, and these portions are joined by welding to each other via a weld portion 37. By this configuration, the cost can be reduced because the 9 to 12 Cr steel rotor material 33 is used in only about half of the entire welded rotor 30.

Figure 4:
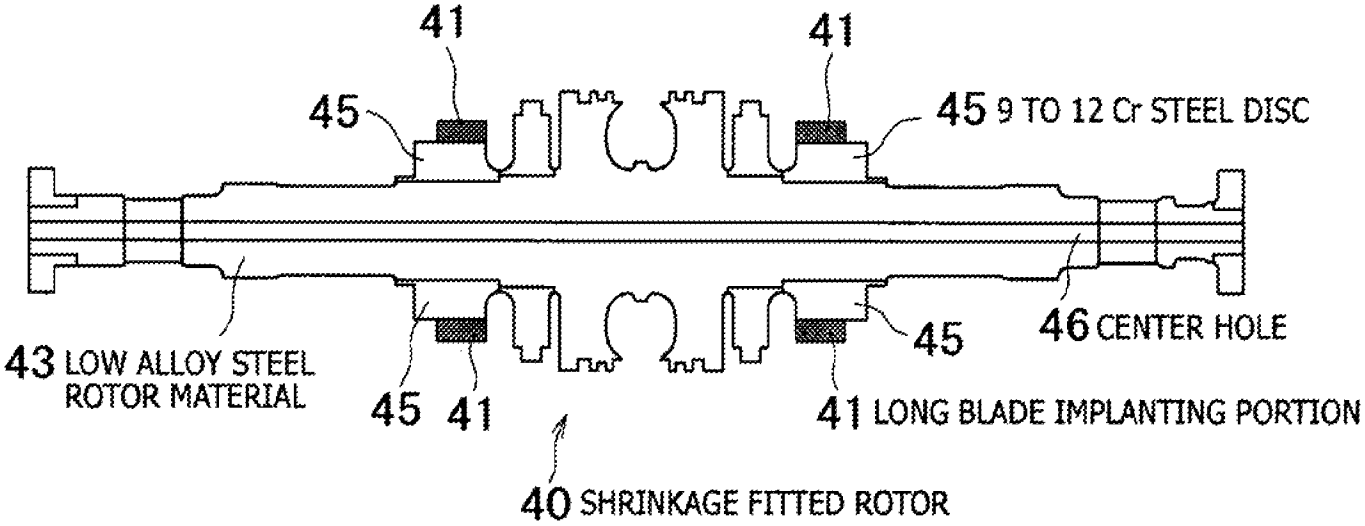
FIG. 4 is a sectional view showing one example of a shrinkage fitted low-pressure turbine rotor.

FIG. 4 is a sectional view of a shrinkage fitted low-pressure turbine rotor in which portions including a long blade implanting portion and other portions are shrinkage fitted to each other. As shown in FIG. 4, in a shrinkage fitted rotor 40, a 9 to 12 Cr steel disc 45 formed integrally with a long blade implanting portion 41 is joined by shrinkage fitting to a rotor body formed by a low alloy steel rotor material 43. By this configuration, the cost can be reduced more remarkably because the 9 to 12 Cr steel is used in only a part of the entire shrinkage fitted rotor 40.

Example 1

Hereunder, the present invention is explained based on examples. Table 1 gives the chemical composition (wt %) of a high-strength steel relating to a material for steam turbine long blade. In Table 1, the balance consists of Fe and unavoidable impurities. After being subjected to 50 kg high frequency vacuum melting, each sample was hot forged into a square bar or round bar, and was subjected to the following heat treatment.

TABLE 1

| Sample No. | | Chemical composition (wt %) | | | | | | | | | | |
|---|---|---|---|---|---|---|---|---|---|---|---|---|
| | | Cr | Ni | Mo | C | Si | Mn | P | S | Nb + Ta | N | Al |
| Other steel type | 1 | 11.94 | 2.54 | 0.99 | 0.12 | 0.05 | 0.03 | 0.001 | 0.002 | 0.05 | 0.016 | — |
| | 2 | 11.80 | 2.51 | 1.46 | 0.11 | 0.03 | 0.01 | 0.001 | 0.001 | 0.05 | 0.017 | — |
| | 3 | 15.39 | 4.21 | — | 0.04 | 0.27 | 0.43 | 0.026 | 0.003 | 0.23 | 0.035 | — |
| | 4 | — | 18.50 | 5.04 | 0.03 | 0.10 | 0.01 | 0.003 | 0.001 | — | — | 0.07 |
| Steel of this invention | 5 | 12.34 | 8.47 | 2.15 | 0.04 | 0.07 | 0.04 | 0.003 | 0.004 | 0.01 | 0.004 | 1.10 |
| | 6 | 14.03 | 8.35 | 2.16 | 0.04 | 0.06 | 0.04 | 0.005 | 0.004 | 0.01 | 0.005 | 1.28 |
| | 7 | 12.39 | 8.45 | 2.14 | 0.03 | 0.06 | 0.05 | 0.003 | 0.004 | 0.01 | 0.005 | 1.36 |
| | 8 | 12.39 | 8.45 | 2.14 | 0.04 | 0.07 | 0.04 | 0.002 | 0.002 | 0.01 | 0.003 | 1.52 |
| | 9 | 12.37 | 8.45 | 2.14 | 0.04 | 0.08 | 0.04 | 0.002 | 0.002 | 0.01 | 0.006 | 1.72 |
| | 10 | 12.37 | 8.34 | 2.13 | 0.03 | 0.07 | 0.05 | 0.002 | 0.003 | 0.01 | 0.005 | 2.13 |
| | 11 | 12.33 | 8.42 | 2.14 | 0.04 | 0.19 | 0.39 | 0.024 | 0.004 | 0.01 | 0.008 | 1.31 |
| Comparative steel | 12 | 14.57 | 8.15 | 2.25 | 0.04 | 0.07 | 0.04 | 0.003 | 0.002 | 0.01 | 0.005 | 1.81 |
| | 13 | 12.42 | 8.29 | 2.13 | 0.04 | 0.06 | 0.04 | 0.003 | 0.005 | 0.01 | 0.044 | 1.33 |

| Sample No. | | Chemical composition (wt %) | | | | | Total content of Cr and Mo | Ni equivalent | Cr equivalent |
|---|---|---|---|---|---|---|---|---|---|
| | | V | Co | Cu | Ti | Fe | | | |
| Other steel type | 1 | 0.20 | — | — | — | Balance | 12.93 | 6.55 | 13.61 |
| | 2 | 0.21 | 1.09 | — | — | Balance | 13.26 | 6.24 | 14.14 |
| | 3 | — | — | 3.43 | — | Balance | 15.39 | 7.53 | 16.33 |
| | 4 | — | 7.92 | — | 0.48 | Balance | 5.04 | 19.41 | 8.87 |
| Steel of this invention | 5 | — | — | — | — | Balance | 14.49 | 9.79 | 21.77 |
| | 6 | — | — | — | — | Balance | 16.19 | 9.70 | 24.45 |
| | 7 | — | — | — | — | Balance | 14.53 | 9.50 | 23.22 |
| | 8 | — | — | — | — | Balance | 14.53 | 9.75 | 24.12 |
| | 9 | — | — | — | — | Balance | 14.51 | 9.82 | 25.22 |
| | 10 | — | — | — | — | Balance | 14.50 | 9.39 | 27.44 |
| | 11 | — | — | — | — | Balance | 14.47 | 10.02 | 23.14 |
| Comparative steel | 12 | — | — | — | — | Balance | 16.82 | 9.50 | 28.06 |
| | 13 | — | — | — | — | Balance | 14.55 | 10.61 | 23.07 |

Samples 1 and 2 are 12 Cr-based steels having high strength and high toughness. These samples were oil quenched after being heated at 1100° C. for 2 hours, and were air cooled and tempered after being heated at an arbitrary temperature in the range of 400 to 650° C. for 3.5 hours. Sample 3 is a 17-4PH steel, which is a currently used long blade material. This sample was air cooled and quenched after being heated at 1038° C. for 1 hour, and was air cooled and subjected to aging treatment after being heated at an arbitrary temperature in the range of 450 to 650° C. for 3 hours. Sample 4 is a commercially available steel called a maraging steel. This sample was air cooled and quenched after being heated at 820° C. for 2 hours, and was air cooled and subjected to aging treatment after being heated at an arbitrary temperature in the range of 410 to 550° C. for 5 hours. Samples 5 to 11 are steels according to the present invention. These samples were air cooled and quenched after being heated at 925° C. for 1 hour, and were air cooled and subjected to aging treatment after being heated at an arbitrary temperature in the range of 450 to 620° C. for 4 hours. Samples 12 and 13 are comparative steels for comparison with the steel of the present invention. These samples were air cooled and quenched after being heated at 925° C. for 1 hour, and were air cooled and subjected to aging treatment after being heated at 925° C. for 1 hour.

Figure 5:
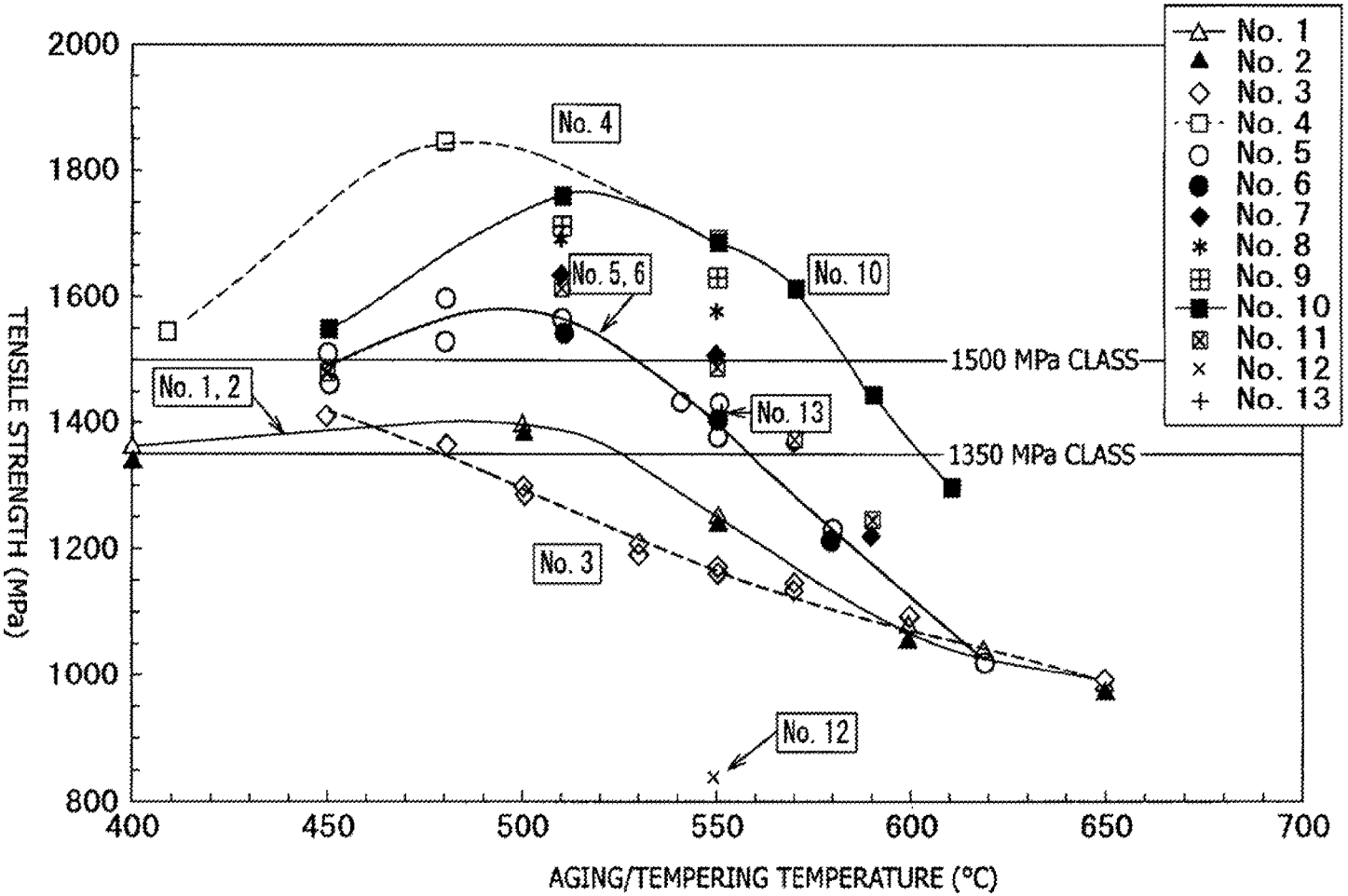
FIG. 5 is a graph showing a change in tensile strength with respect to aging/tempering temperature.
Figure 6:
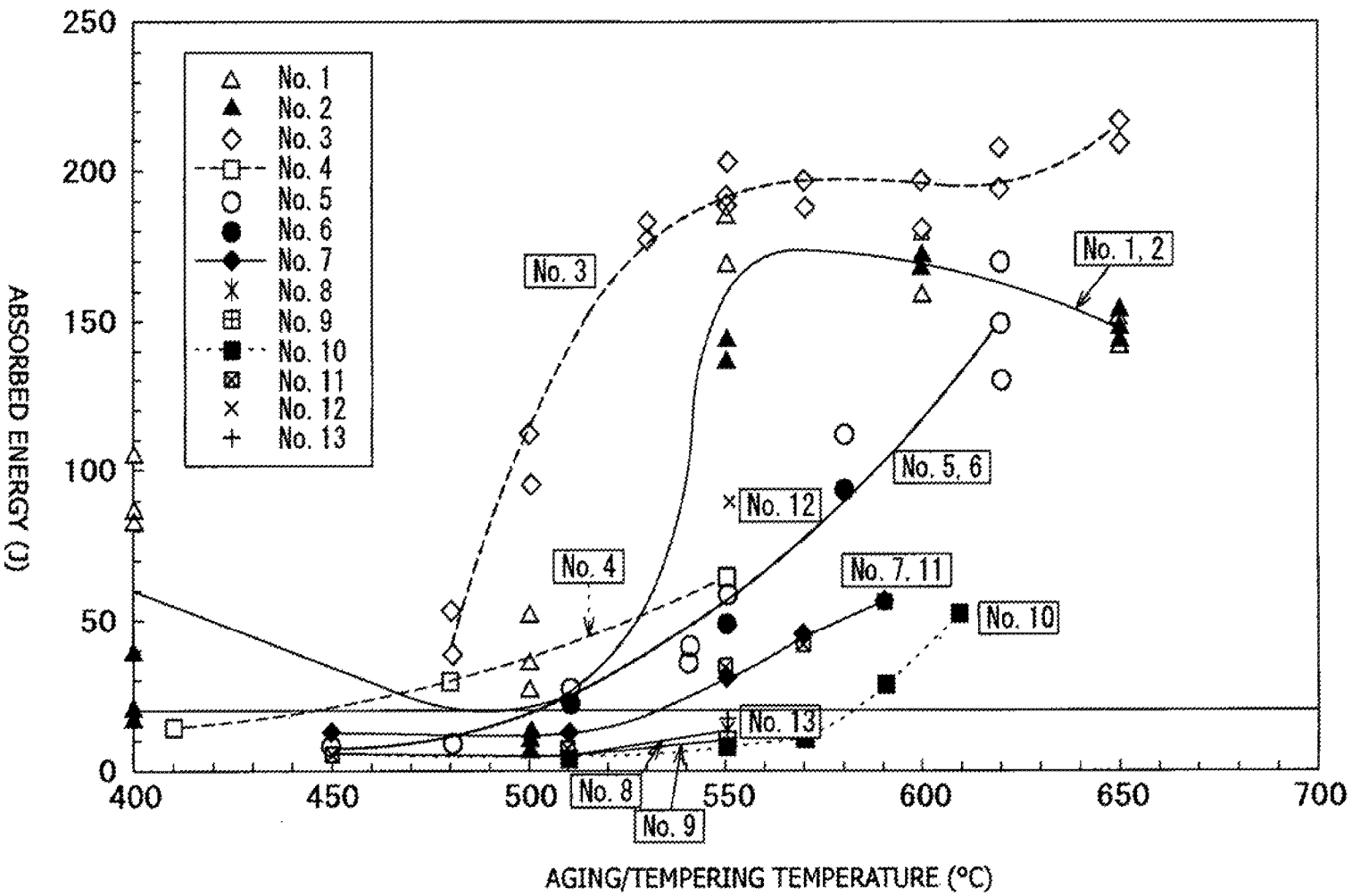
FIG. 6 is a graph showing a change in absorbed energy with respect to aging/tempering temperature.

These samples 1 to 13 were subjected to a tensile test and a Charpy impact test at room temperature (20° C.). The results are shown in FIGS. 5 and 6. FIG. 5 is a graph showing the change in tensile strength with respect to the aging/tempering temperature of each sample. FIG. 6 is a graph showing the change in Charpy absorbed energy with respect to the aging/tempering temperature of each sample. As shown in FIGS. 5 and 6, samples 5 and 6 of the steels according to the present invention achieved, due to aging at about 550° C., properties of tensile strength not lower than 1350 MPa and Charpy absorbed energy not lower than 20 J, which were required by a blade material for the 45-inch class blade length (for the steam turbine of 3600 rpm). Also, due to aging at about 510° C., these samples achieved properties of tensile strength not lower than 1500 MPa and Charpy absorbed energy not lower than 20 J, which were required by a blade material for the 50-inch class blade length (for the steam turbine of 3600 rpm).

Also, sample 7 of the steel according to the present invention, which contains 1.36% of aluminum, achieved properties of tensile strength not lower than 1500 MPa and Charpy absorbed energy not lower than 20 J due to aging at about 580° C. as shown in FIGS. 5 and 6. Sample 10 of the steel according to the present invention, which contains 2.13% of aluminum, achieved properties of tensile strength not lower than 1500 MPa and Charpy absorbed energy not lower than 20 J due to aging at about 580° C. as shown in FIGS. 5 and 6. For comparison of results in the case where the Al content is increased, FIGS. 7 and 8 summarize the results for sample 5 and samples 7 to 11.

Figure 7:
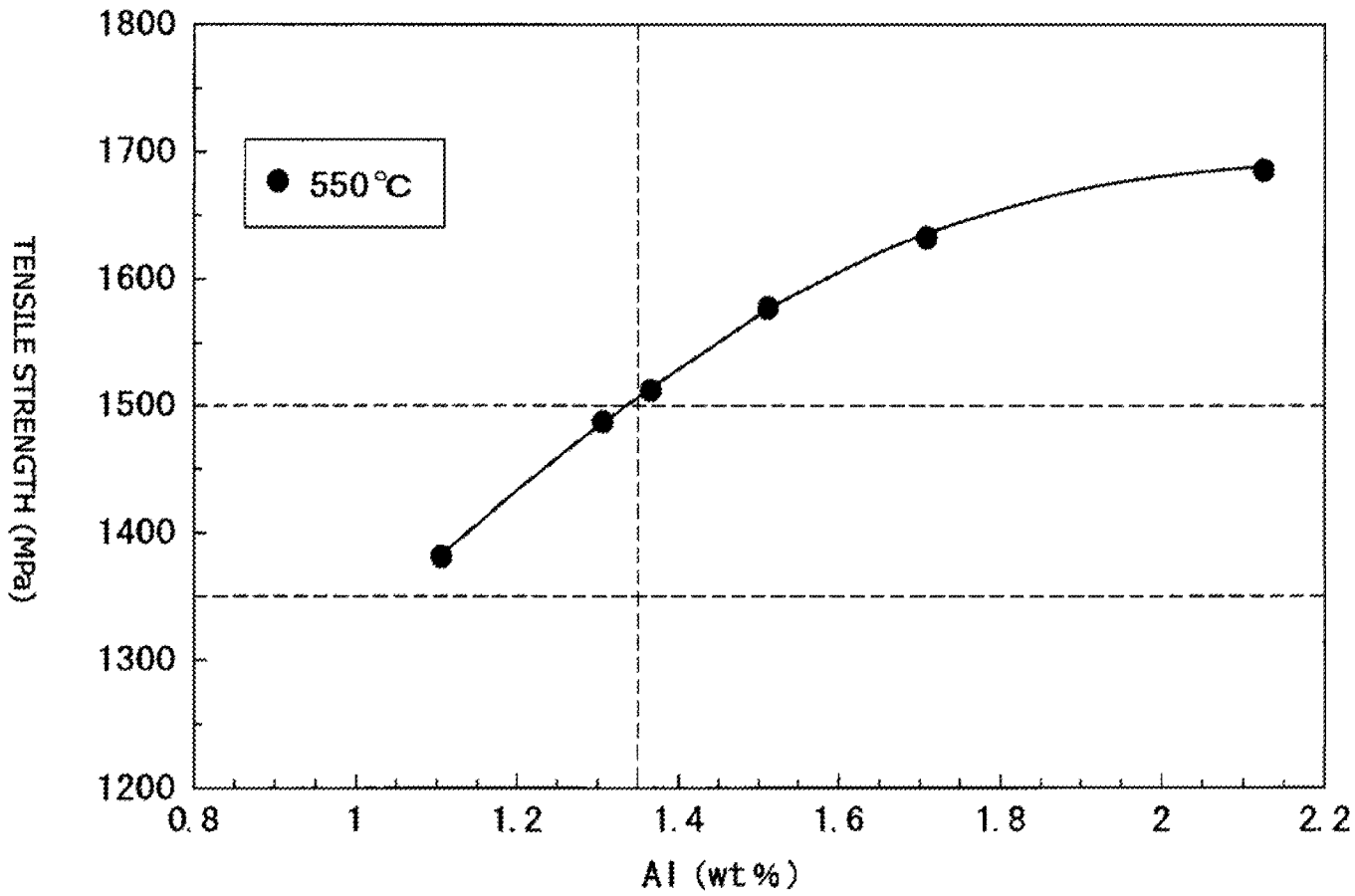
FIG. 7 is a graph showing a change in tensile strength with respect to Al content.
Figure 8:
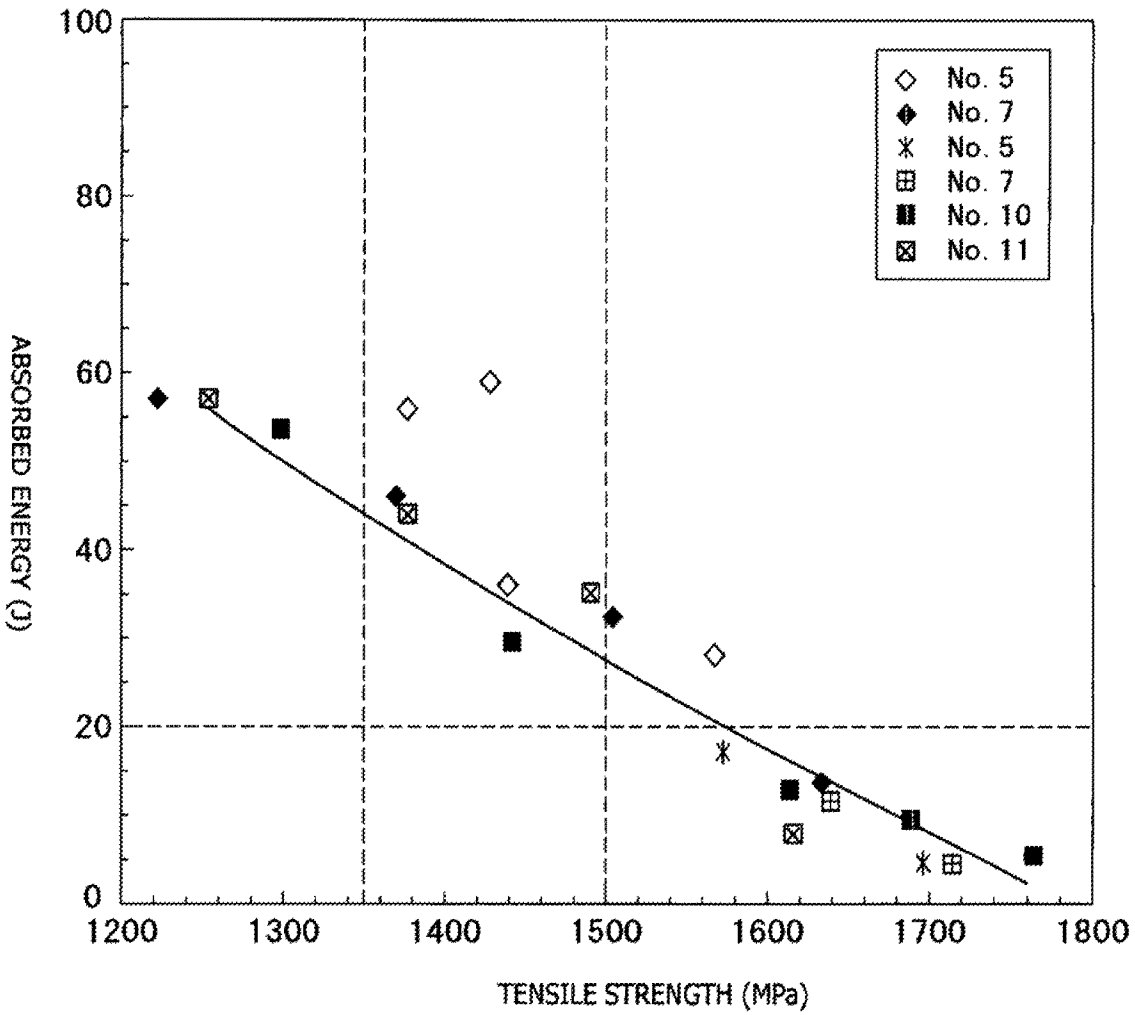
FIG. 8 is a graph showing the relationship between tensile strength and absorbed energy.

As shown in FIG. 7, at the aging temperature of 550° C., the tensile strength increased as the Al content increased. From the viewpoint of delayed cracks, the aging temperature should preferably be as high as possible to give an excessive aging condition, and it was found that at an aging temperature of 550° C., which sufficiently gives the excessive aging condition, a tensile strength not lower than 1500 MPa can be obtained by increasing the Al content to 1.35% or higher. Also, as shown in FIG. 8, there is a tendency for the Charpy absorbed energy to decrease as the tensile strength increases. It was found that Charpy absorbed energy not lower than 20 J is achieved even at tensile strengths of 1350 MPa and 1500 MPa, and the steel of this invention achieves Charpy absorbed energy not lower than 20 J if it has a tensile strength not higher than about 1580 MPa.

Also, sample 11, which contains 0.39% Mn, 0.19% Si, and 0.024% P, could achieve high tensile strength and Charpy absorbed energy as shown in FIGS. 5 and 6, like samples of the steels according to the present invention in which the contents of Mn, Si and P are decreased.

On the other hand, sample 12, which is a comparative steel and has a Cr equivalent exceeding 28.0, showed a very low tensile strength of about 800 MPa, and thus did not achieve the required strength properties because a δ ferrite phase precipitated in large amounts. Also, sample 13, which is a comparative steel and has a Ni equivalent exceeding 10.5, showed Charpy absorbed energy lower than 20 J under the aging condition of 550° C. under which the tensile strength was 1350 MPa because a residual austenite phase was yielded, so that a necessary toughness could not obtained.

Also, sample 1 of a 12 Cr-based steel, which is of a steel type different from the steel according to the present invention, attained the target value of 1350 MPa class such that the tensile strength was not lower than 1500 MPa and the Charpy absorbed energy was not lower than 20 J due to tempering at a temperature not higher than about 500° C., but did not achieve the tensile strength of 1500 MPa class. Sample 2 had a tensile strength not higher than 1350 MPa in the tempering at a temperature exceeding about 500° C., and had Charpy absorbed energy not higher than 20 J in the tempering at a temperature not higher than about 500° C., so that sample 2 did not attain even the target value of 1350 MPa class.

Sample 3 of a 17-4PH steel, which is a precipitation hardened stainless steel that is the same as the steel according to the present invention, attained the target value of 1350 MPa class such that the tensile strength was not lower than 1500 MPa and the Charpy absorbed energy was not lower than 20 J due to aging at a temperature of about 480° C., but did not achieve the tensile strength of 1500 MPa class. Also, for sample 4, which is a commercially available maraging steel, the tensile strength and Charpy absorbed energy attained the target value of 1350 MPa class and the target value of 1500 MPa class due to aging at a temperature of about 480 to 550° C.

Figure 9:
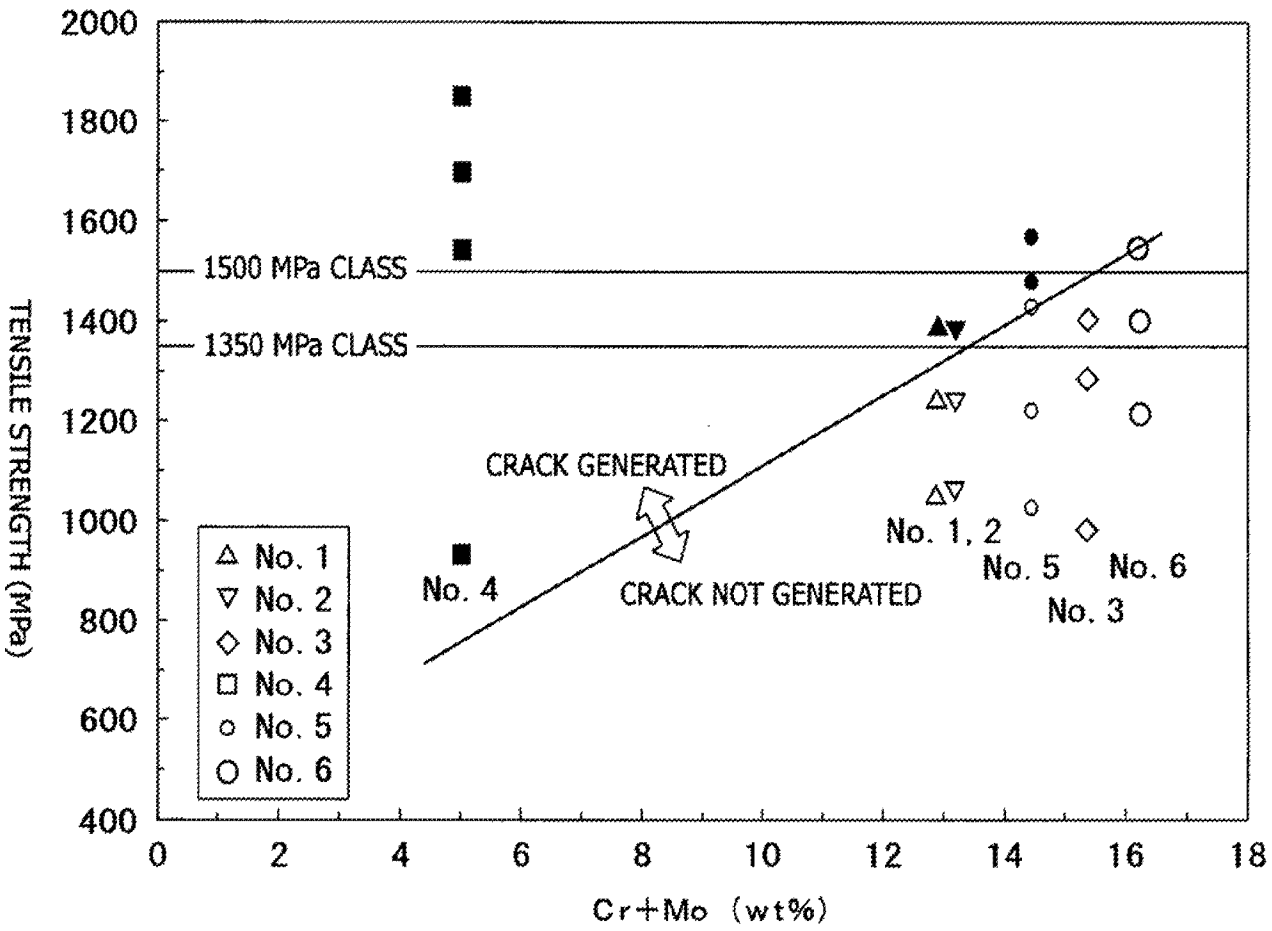
FIG. 9 is a graph showing a change in delayed crack generation limit strength with respect to total content of Cr+Mo.
Figure 10:
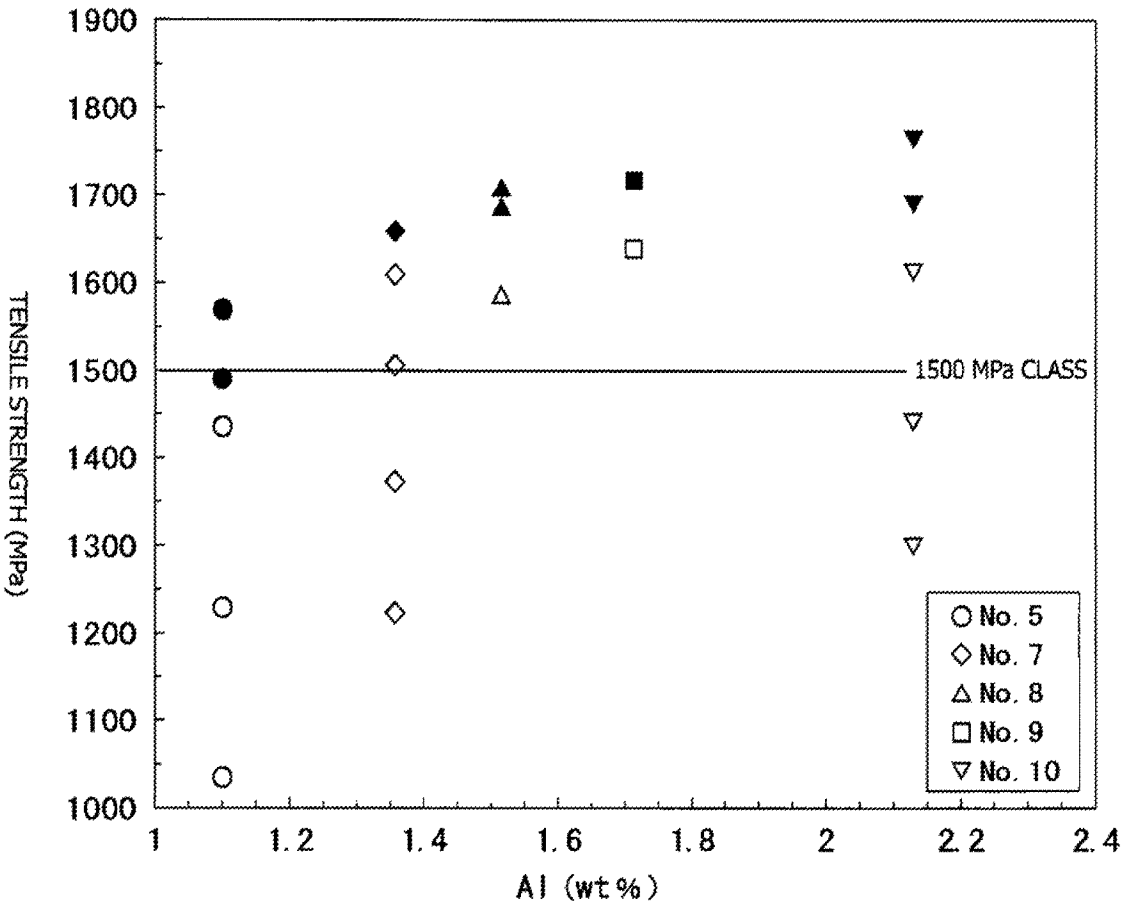
FIG. 10 is a graph showing a change in delayed crack generation limit strength with respect to Al content.

Next, delayed cracking tests were conducted on samples 5 to 10 of the steels according to the present invention and samples 1 to 4 of other steel types. In the delayed cracking test, it was examined whether or not a crack was generated on a sample immersed in water having a temperature of 80° C. and a dissolved oxygen concentration of 8.0 ppm for 500 hours. The results are shown in FIGS. 9 and 10. FIG. 9 is a graph showing the change in tensile strength at a limit at which a crack is generated by a delayed cracking test (delayed crack generation limit strength) with respect to the total content of Cr+Mo for samples 1 to 6. FIG. 10 is a graph showing a change in delayed crack generation limit strength with respect to the Al content for samples 5 and 7 to 10. In FIGS. 9 and 10, a black mark indicates that a crack was generated, and an outline type mark indicates that no crack was generated.

As shown in FIG. 9, on samples 1, 2 and 4 of other steel types, a delayed crack was generated at the strength level of 1350 MPa or more class. On the other hand, on sample 3 of other steel types and sample 5 of the steel according to the present invention, no delayed crack was generated even in the 1350 MPa class. However, in the case where a strength of 1500 MPa class was required, a delayed crack was generated. On sample 6 of the steel according to the present invention, no delayed crack was generated in the target 1350 MPa class, and further no delayed crack was generated even in the 1500 MPa class. Thus, a delayed crack is more liable to be generated as the tensile strength increases, and also it is recognized that the delayed crack generation limit strength correlates well with the total content of Cr+Mo, which is a parameter generally representing corrosion resistance. Therefore, it can be seen that a delayed crack is less liable to be generated as the total content of Cr+Mo increases. That is to say, from FIG. 9, the generation of delayed crack can be prevented even in the 1500 MPa class by making the total content of Cr+Mo 15.5 wt % or higher.

Also, from FIG. 10, in which delayed cracking properties are compared in the case where the Al content is increased, on samples 7 to 10 of the steel according to the present invention, in which the Al content exceeded 1.35%, no delayed crack was generated at a tensile strength of 1500 MPa class. As given in Table 1, although these samples had a low total content of Cr+Mo of about 14.5%, the generation of delayed crack could be prevented even in the 1500 MPa class. That is to say, in the case where the Al content is high, and the tensile strength is not lower than 1500 MPa even when the aging temperature is not lower than 550° C. in the over aging region, high delayed cracking properties can be achieved even when the total content of Cr+Mo is still in a low range of less than 15.5%.

Figure 11:
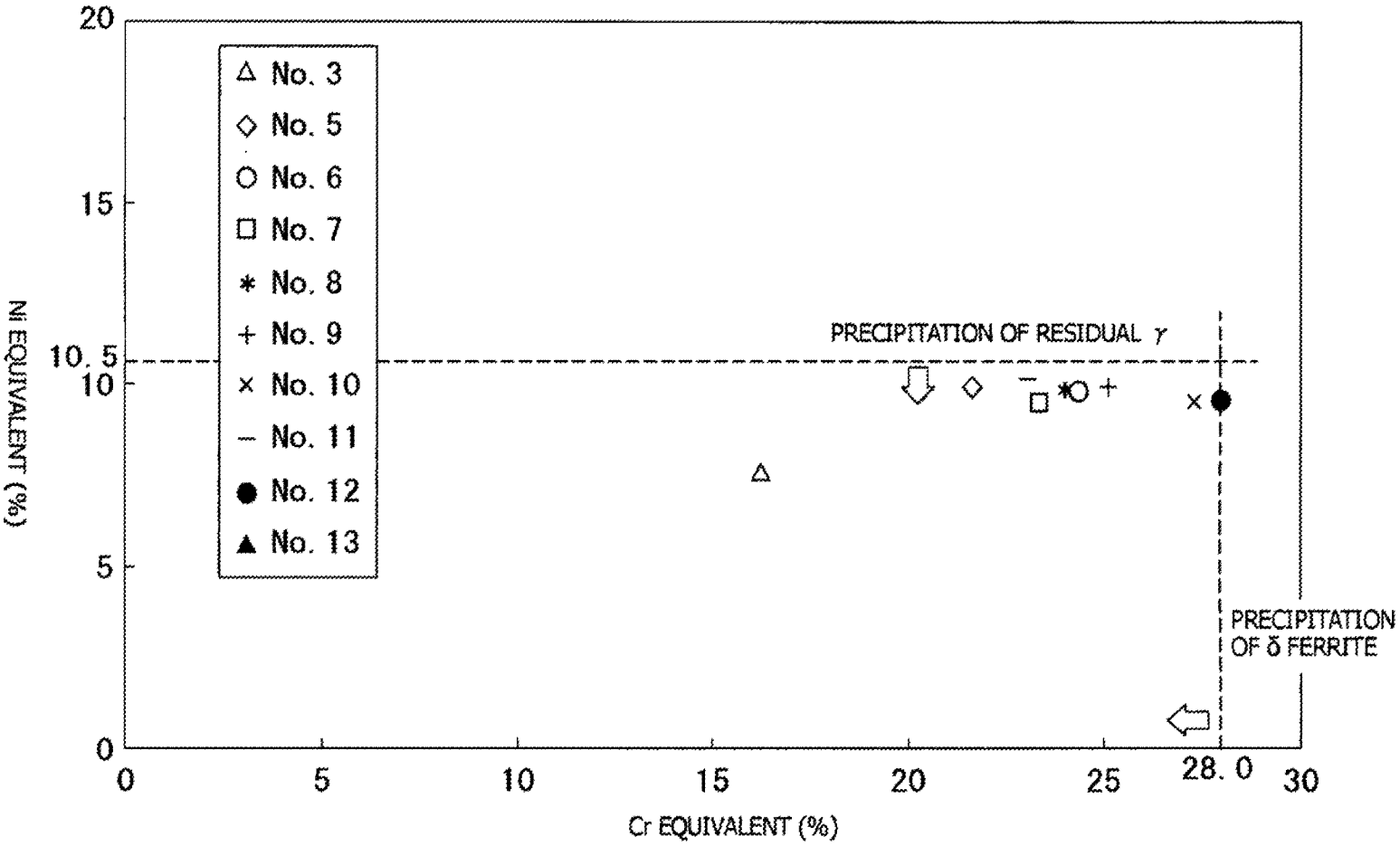
FIG. 11 is a graph showing the influence of Cr equivalent and Ni equivalent on the structure (Schaeffler's phase diagram).

Further, detecting tests of δ ferrite phase precipitation and residual austenite phase precipitation were conducted on sample 3 of other steel types, samples 5 to 11 of the steels according to the present invention, and samples 12 and 13 of comparative steels. In the detecting test, the structure of sample subjected to the aforementioned heat treatment was observed under an optical microscope. As a result, although the precipitation of δ ferrite phase exceeding 1% was detected on sample 12, the precipitation amount of δ ferrite phase was as small as 1% or less on other samples. Also, although the residual austenite phase precipitation was detected on sample 13, it was not detected on other samples. FIG. 11 shows the influences of Cr equivalent and Ni equivalent on the structure (Schaeffler's phase diagram) for samples 3 and 5 to 13. As shown in FIG. 11, in the case where the Cr equivalent is less than 28.0 and the Ni equivalent is less than 10.5, both of the δ ferrite phase precipitation and the residual austenite phase precipitation can be avoided.

Table 2 summarizes the above results. As given in Table 2, samples 5 to 11 of the steels according to the present invention attained all target values of the 1350 MPa class. Sample 6, in which the total content of Cr+Mo was 15.5 wt % or higher, attained the target value of the 1500 MPa class. Also, samples 7 to 10, in which the Al content was higher than 1.35 wt %, also attained the target value of the 1500 MPa class.

TABLE 2

| Sample No. | | Tensile strength | Charpy absorbed energy | Delayed cracking properties (SCC properties) | Structure (δ ferrite/residual austenite precipitation) | Comprehensive rating |
|---|---|---|---|---|---|---|
| Other steel type | 1 | ○ | ○ | X | ○ | X |
| | 2 | ○ | X | X | ○ | X |
| | 3 | ○ | ○ | ○ | ○ | ○ |
| | 4 | ◎ | ◎ | X | ◎ | X |
| Steel of this invention | 5 | ◎ | ◎ | ○ | ◎ | ○ |
| | 6 | ◎ | ◎ | ◎ | ◎ | ◎ |
| | 7 | ◎ | ◎ | ◎ | ◎ | ◎ |
| | 8 | ◎ | ◎ | ◎ | ◎ | ◎ |
| | 9 | ◎ | ◎ | ◎ | ◎ | ◎ |
| | 10 | ◎ | ◎ | ◎ | ◎ | ◎ |
| | 11 | ◎ | ◎ | ○ | ◎ | ○ |
| Comparative steel | 12 | X | ○ | — | X | X |
| | 13 | ○ | X | — | X | X |

○: Target of 1350 MPa attained
◎: Target of 1500 MPa also attained
X: Target not attained
—: Untested

Example 2

Hereafter is described a procedure by which the long blade having a 45-inch class blade length (for the steam turbine of 3600 rpm) shown in FIG. 1 was manufactured by using the steel having the chemical composition of sample 6 shown in Example 1. First, a steel having the chemical composition of sample 6 was subjected to vacuum induction melting, and then subjected to vacuum arc remelting, by which a round bar shaped raw material with a diameter of about 200 mm was manufactured by hot forging. Subsequently, the raw material was subjected to rough cogging so as to form a shape of dumplings on a skewer, the shape having different diameters according to the thickness of each portion of the blade root etc., and was formed into a near-net shape by die forging after being heated to a high temperature, thereafter being subjected to heat treatment. For the heat treatment, after heating was performed at 925° C. for 2 hours, forced air cooling was performed, and solution heat treatment was performed so that a tensile strength not lower than 1350 MPa was provided. Thereafter, after heating was performed at 550° C. for 4 hours, air cooling was performed, and aging treatment was performed. Finishing work was done by straightening, grinding, and machining, by which a long blade having a 45-inch class blade length was manufactured.

Test pieces were cut out of portions (blade tip end, blade center, blade root) of the manufactured blade, and the tensile test and the Charpy impact test were conducted at room temperature (20° C.). The results are given in Table 3. The test pieces of all portions attained the target value such that the tensile strength was not lower than 1350 MPa and the Charpy absorbed energy was not lower than 20 J. Also, it was confirmed that the structure was a microstructure of martensite single phase in which the precipitation of δ ferrite phase was not found, and the 45-inch blade had sound properties.

TABLE 3

| Test piece cut position | Test direction | 0.2% proof stress (MPa) | Tensile strength (MPa) | Elongation (%) | Reduction of area (%) | Absorbed energy (J) |
|---|---|---|---|---|---|---|
| Blade tip end | Lengthwise | 1358 | 1411 | 18.6 | 59.5 | 49 |
| Blade center | Lengthwise | 1362 | 1411 | 18.1 | 60.3 | 49 |
| Blade root | Lengthwise | 1298 | 1398 | 19.1 | 58.6 | 44 |

INDUSTRIAL APPLICABILITY

The precipitation hardened martensitic stainless steel in accordance with the present invention has a high strength such that tensile strength is not lower than 1350 MPa and a high toughness such that Charpy absorbed energy at room temperature is not lower than 20 J, and also has high corrosion resistance. Therefore, this martensitic stainless steel can be used not only for a turbine moving blade for a steam turbine but also for a blade of a gas turbine compressor and a chemical plant compressor.

The invention claimed is:

1. A precipitation hardened martensitic stainless steel containing, in percent by weight, 12.25% to 14.25% Cr, 7.5% to 8.5% Ni, 1.0% to 2.5% Mo, 0.05% or less C, 0.2% or less Si, 0.4% or less Mn, 0.03% or less P, 0.005% or less S, 0.003% to 0.008% N, 1.36% to 2.25% Al, optionally Nb or Ta, the balance substantially being Fe, wherein the total content of Cr and Mo is 14.25% to 16.75%, and the total content of Nb and Ta is up to 0.01%, and wherein:

$$\text{a Cr equivalent}=[Cr]+2[Si]+1.5[Mo]+5.5[Al]+1.75[Nb]+1.5[Ti], \text{ and}$$

$$\text{a Ni equivalent}=[Ni]+30[C]+0.5[Mn]+25[N]+0.3[Cu],$$

wherein [Cr], [Si], [Mo], [Al], [Nb], [Ti], [Ni], [C], [N] and [Cu] each represents a content in percent by weight of the recited element, and wherein the Cr equivalent is less than 28.0, and the Ni equivalent is less than 10.5.

2. The precipitation hardened martensitic stainless steel according to claim 1, wherein the total content of Cr and Mo is 15.5% to 16.75% by weight.

3. The precipitation hardened martensitic stainless steel according to claim 1, wherein the content of Al is 1.52% to 2.25% by weight.

4. The precipitation hardened martensitic stainless steel according to claim 1, wherein the content of Al is 1.52% to 2.13% by weight.

5. The precipitation hardened martensitic stainless steel according to claim 1, wherein the precipitation hardened martensitic stainless steel has a tensile strength of at least 1350 MPa and a Charpy absorbed energy of at least 20 J at room temperature.

6. The precipitation hardened martensitic stainless steel according to claim 1, wherein the precipitation hardened martensitic stainless steel has a tensile strength of at least 1500 MPa and a Charpy absorbed energy of at least 20 J at room temperature.

7. The precipitation hardened martensitic stainless steel according to claim 1, wherein the precipitation hardened martensitic stainless steel is obtained by subjecting a steel billet to an aging treatment at 550 to 600° C. after subjecting the steel billet to a solution heat treatment at 910 to 940° C.

8. The precipitation hardened martensitic stainless steel according to claim 1, wherein the precipitation hardened martensitic stainless steel is obtained by subjecting a steel billet to an aging treatment at 550 to 580° C. after subjecting the steel billet to a solution heat treatment at 910 to 940° C.

9. A manufacturing method for the precipitation hardened martensitic stainless steel according to claim 1, comprising subjecting a steel billet, which has a chemical composition, in percent by weight, of 12.25 to 14.25% Cr, 7.5 to 8.5% Ni, 1.0 to 2.5% Mo, 0.05% or less C, 0.2% or less Si, 0.4% or less Mn, 0.03% or less P, 0.005% or less S, 0.003% to 0.008% N, higher than 1.35% and not lower than 2.25% Al, optionally Nb or Ta, the balance substantially being Fe, and the total content of Cr and Mo being 14.25 to 16.75%, the total content of Nb and Ta being up to 0.01%, to aging treatment at 550 to 600° C. after being subjected to solution heat treatment at 910 to 940° C.

10. The manufacturing method for a precipitation hardened martensitic stainless steel according to claim 9, wherein in the precipitation hardened martensitic stainless steel, the total content of Cr and Mo is 15.5 to 16.75%.

11. The manufacturing method for a precipitation hardened martensitic stainless steel according to claim 9, wherein the aging treatment is a temperature range of 550 to 580° C.

12. A turbine moving blade using the precipitation hardened martensitic stainless steel according to claim 1.

13. A steam turbine provided with a turbine moving blade using the precipitation hardened martensitic stainless steel according to claim 1 and a rotor in which a 9 to 12 Cr steel is used for at least a long blade implanting portion.

* * * * *